United States Patent [19]

Oshimi

[11] 4,018,007

[45] Apr. 19, 1977

[54] APPARATUS FOR GRINDING SURFACE PORTIONS OF THICK PLATES

[75] Inventor: Tetsuro Oshimi, Nagoya, Japan

[73] Assignee: Nippon Toki Kabushiki Kaisha, Japan

[22] Filed: Nov. 10, 1975

[21] Appl. No.: 630,529

Related U.S. Application Data

[62] Division of Ser. No. 572,822, April 29, 1975.

[30] Foreign Application Priority Data

May 2, 1974 Japan ..... 49-50030

[52] U.S. Cl. ..... 51/33 R; 51/47

[51] Int. Cl.[2] ..... B24B 7/02

[58] Field of Search ..... 51/33 R, 47, 55, 99

[56] References Cited

UNITED STATES PATENTS

| | | | |
|---|---|---|---|
| 2,651,888 | 9/1953 | Comstock | 51/33 R |
| 2,982,056 | 5/1961 | Edquist | 51/99 X |
| 3,245,176 | 4/1966 | Muehling | 51/33 R |
| 3,253,368 | 5/1966 | Vekovius | 51/33 R |
| 3,339,311 | 9/1967 | Berg | 51/33 R |
| 3,498,004 | 3/1970 | Hensley | 51/99 |
| 3,611,642 | 10/1971 | Stoy | 51/33 R |
| 3,641,709 | 2/1972 | Gazuit | 51/99 X |
| 3,708,920 | 1/1973 | Kaszuba | 51/47 X |
| 3,903,658 | 9/1975 | Daiuta | 51/55 X |

*Primary Examiner*—Al Lawrence Smith
*Assistant Examiner*—Nicholas P. Godici
*Attorney, Agent, or Firm*—Fleit & Jacobson

[57] ABSTRACT

An apparatus comprising a grinding unit supported on and movable along a transversal beam provided in a wagon which is movable along a pair of spaced rails. The grinding unit includes a stationary frame on which a transversal beam is movably supported. A shaft member is rotatably mounted in a hollow member secured to said transversal beam and has fork-shaped frames fixed to the lower end thereof. A frame is pivotably supported between the lower ends of the fork-shaped frames and has a shaft bearing sleeve secured to a front portion of said frame. A grinder wheel shaft carries a grinding wheel and is rotatably received in the shaft bearing sleeve. There is provided means for swinging said fork-shaped frames about an axis of said shaft member. Cam means are mounted on the underside of a base member secured to the top of the hollow member to define a gap therebetween. A roller is rotatably supported on the top of a L-shaped link pivoted to the top of the fork-shaped frames and is received in the gap to roll along said cam means. The other end of the L-shaped link is linked through to the shaft bearing sleeve on said frame.

2 Claims, 10 Drawing Figures

APPARATUS FOR GRINDING SURFACE PORTIONS OF THICK PLATES

This is a divisional application of U.S. Ser. No. 572,822, filed Apr. 29, 1975.

BACKGROUND OF THE INVENTION

This invention relates to an apparatus for grinding surface portions of thick plates, and its object is to permit the grinder wheel to be naturally or smoothly raised for separation from and lowered into contact with the workpiece near the turning points of its oscillatory or swinging motion when removing local irregularities or other imperfections from the surface of thick plates, so as to eliminate unevenness at the opposite ends of the ground area and obtain a smoothly continuous finished surface while providing a constant grinding pressure to accommodae for large warp of the workpiece plate and irrespective of the wear of the grinding wheel.

Heretofore, the removal of local irregularities or imperfections from the surface of this type of thick plate having comparatively broad areas has been achieved with a hand grinder or wagon grinder, and it has been in practice to manually accomplish the swinging of the grind stone or grinding wheel and manually bring it into contact with and separate it from the workpiece. However, this operation not only requires extremely high skill or dexterity, but also poses difficulties in obtaining a uniform quality of finish.

In view of the above inconveniences, according to the present invention the grinding wheel is imparted with a motion that automatically raises it off and brings it into contact with the workpiece being ground at the turning points in its swinging or oscillatory movement, while also permitting a constant grinding pressure to be provided for grinding even if there is large warp in the thick plate of the workpiece and irrespective of the wear of the grinding wheel. An embodiment of the invention will now be described with reference to the accompanying drawings.

BRIEF DESCRIPTION OF THE DRAWINGS

Referring to FIGS. 1, 2 and 3, there is shown a grinding machine 1 comprising a gate-shaped wagon 6 having pairs of wheels 3 and 3′ each pair on each side and adapted to roll over respective rails 2 and 2′ extending parallel to each other in the fore-and-aft direction and spaced a large distance apart from each other. The wagon comprises opposite said frames 4 and 4′ which are assembled together by a transversal horizontal beam 5 bridging substantially the central portions of the opposite frames. In the frame 4 on the left hand side in FIGS. 1 and 2 a wagon drive motor 7 for moving the wagon at fast and slow speeds is mounted. The left and right frames 4 and 4′ can thus be moved in forward and backward via a connecting rod 8. The beam 5 is provided with rails 9 extending along its four corners, and a number of follers (not shown) provided in a transversal grinding unit 10 are arranged in a fashion to clamp the rails 9 in the vertical and horizontal directions and roll therealong. The transversal grinding unit 10 can be moved in transversal directions at fast and slow speeds by a transversal drive motor 11 provided in the frame 4 via a chain 12.

The transversal grinding unit 10 has a base member 13, in which the afore-mentioned number of rollers (not shown) adapted to roll along the rails 9 are accommodated. Secured to the base member 13 and extending in the fore-and-aft direction is a beam member 14, and a frame 15 depends from the front end of the beam member 14, as shown in FIGS. 4 and 5. The frame 15 supports an upright powder cylinder 16 mounted in its central portion and parallel vertical guide bars 17 each mounted at its each end. A vertically movable transversal beam 18 has its opposite end portions slidably supported on the respective guide bars 17. The power cylinder 16 has a rod 19 having the lower end thereof pivoted to substantially the center of the transversal beam 18. A hollow cylindrical member 20 is secured to the beam 18 on the front of the rod 19, and a shaft member 21 is rotatably fitted in the cylindrical member 20. Secured to the top of the cylindrical member 20 is a base member 22, and secured to the underside thereof is a box-shaped cam base 23. As shown in FIG. 6, cam members 25 and 26 are disposed within the cam box 23 for fine adjustment by means of bolts 24 to define a gap C therebetween. The intermedate line mid way in the gap C has a radius of curvature substantially equal to the radius of curvature of the aforementioned swinging motion (for instance 200 mm) in the vicinity of the center of the gap, and its radius of curvature in the vicinity of the opposite ends of the gap is about one half that of the swinging motion (for instance 100 mm).

As shown in FIGS. 7, 8 and 9, a base member 27 is secured to a suitable portion of the front side of the transversal beam 18, and a swing drive motor 28 and a speed reduction gear means 29 are mounted on the top of the base member 27. A rotative shaft 30 depending from the speed reduction gear means 29 carries a rotative disc 31 secured to its lower end. A support bolt 32 is secured to the rotative disc 31 and penetrates a portion thereof. Meanwhile, a boss 33 is fitted on and keyed by a key 34 to a lower portion of the shaft member 21 for rotation in unison therewith. Secured to diametrically opposite sides of the periphery of the boss 33 and depending therefrom are fork-shaped pair frames 35 which are provided at the lower end with respective bearings 36. A support member 37 is secured to the top of one of the fork-shaped frames 30 closer to the afore-mentioned rotative shaft 30, and it carries a support bolt 38 extending upright from its tip. The support bolt 38 is tied to the afore-mentioned support bolt 32 via an adjustable connecting rod whose length is adjustable, for instance by means of a turn backle.

Figure 6:
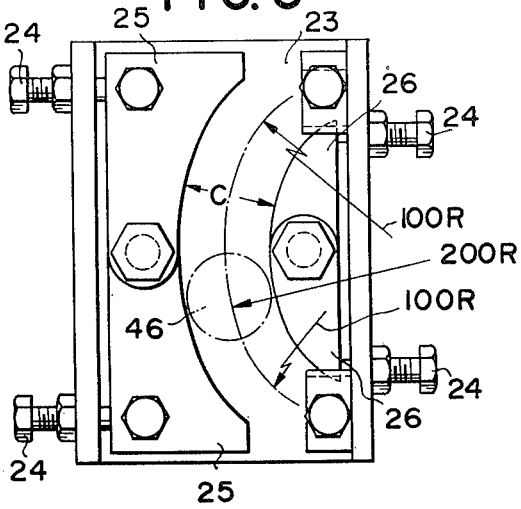
FIG. 6 is a plan view to an enlarged scale showing the cam section.

A support bracket 40 is secured by means of screws to substantially the central portion of the front top of the fork-shaped pair frames 35, and pivoted to the top of the support bracket 40 by pin 42 is a vertically pivotable L-shaped link 41. The front end of the forwardly extending arm of the L-shaped link 41 is pivoted to an air cylinder 43. A base member 44 is horizontally secured to the top end of the upwardly extending arm of the L-shaped link 41. A bolt 45 extends upright substantially from the center of a front portion of the base member 44, and it carries a roller 46, which has a diameter slightly smaller than the transversal dimension of the afore-mentioned gap C between the cam members 25 and 26 shown in FIG. 6 and is capable of rolling within the gap.

Figure 3:
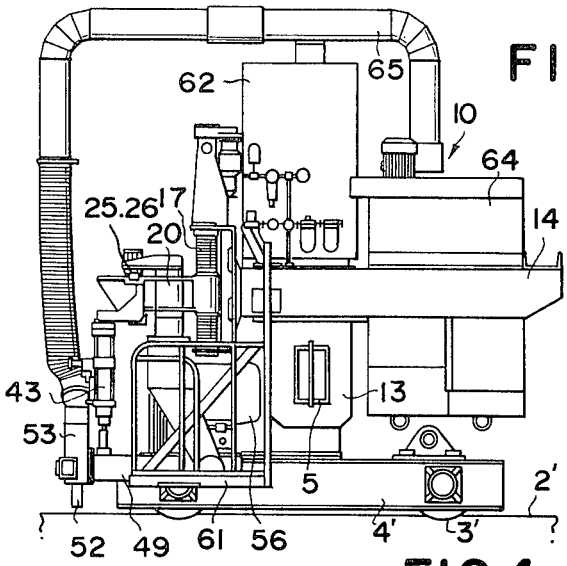
FIG. 3 is a side view of the same.
Figure 4:
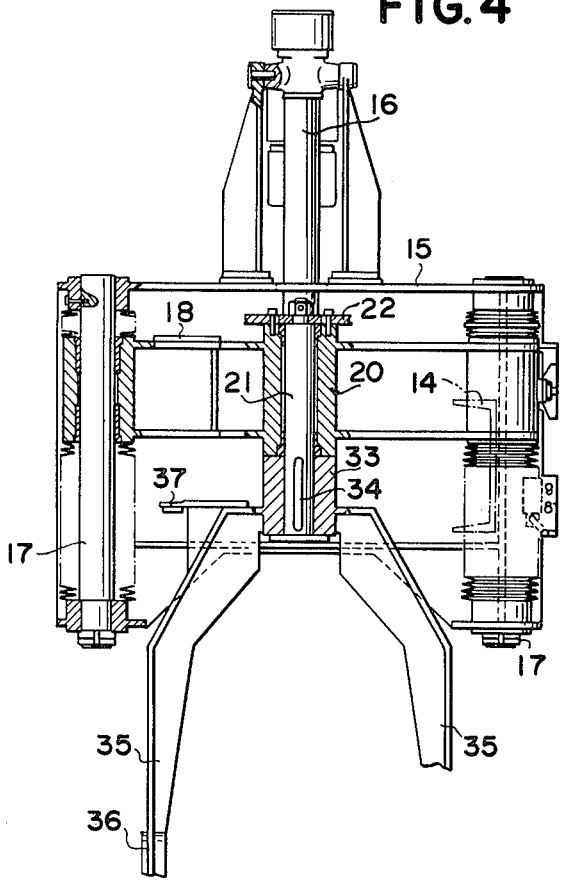
FIG. 4 is a fragmentary sectional view to an enlarged scale showing a vertically movable mechanism movable along vertical guide bars.
Figure 5:
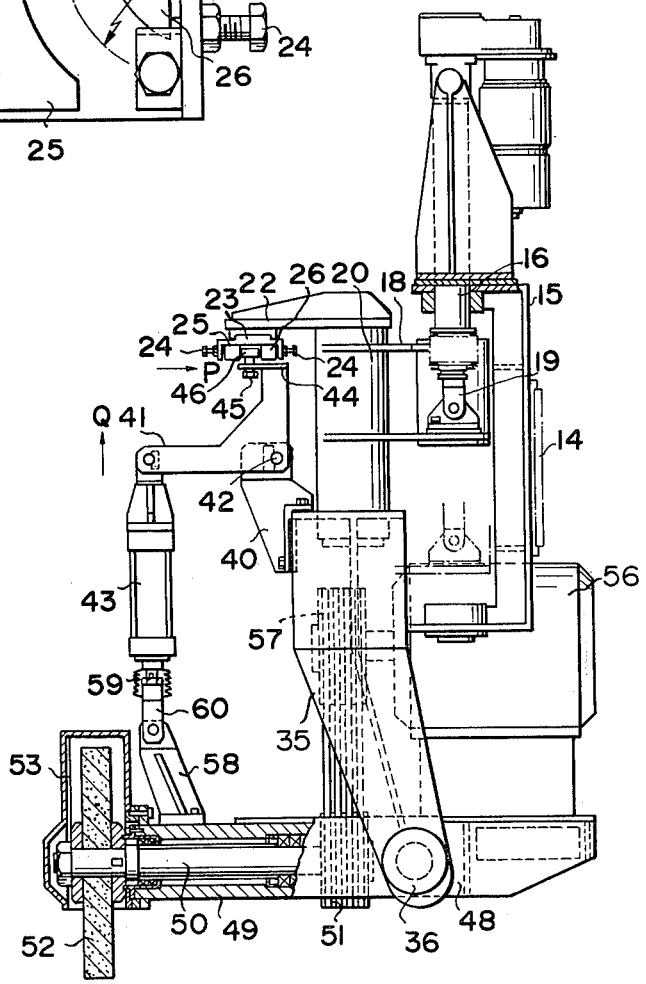
FIG. 5 is a side view of the assembly including swinging mechanism, cam section, air cylinder section and power cylinder section.
Figure 7:
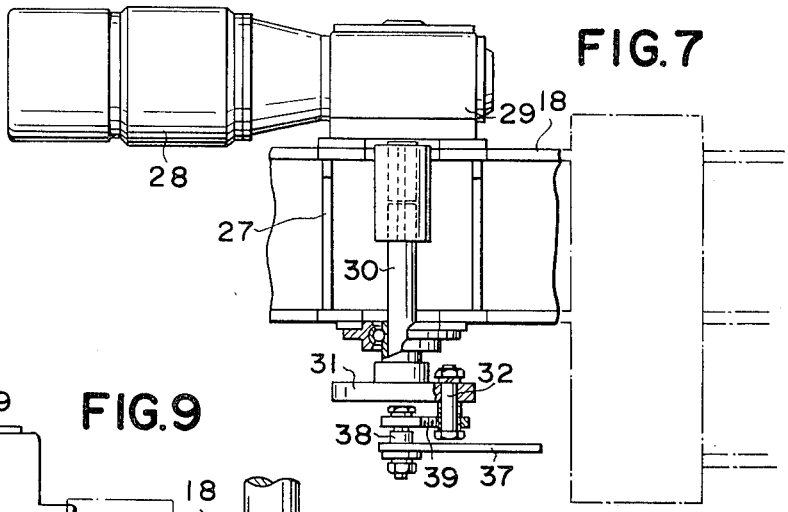
FIG. 7 is a fragmentary elevational view to an enlarged scale showing the arrangement of swing drive motor and rotative disc.
Figure 9:
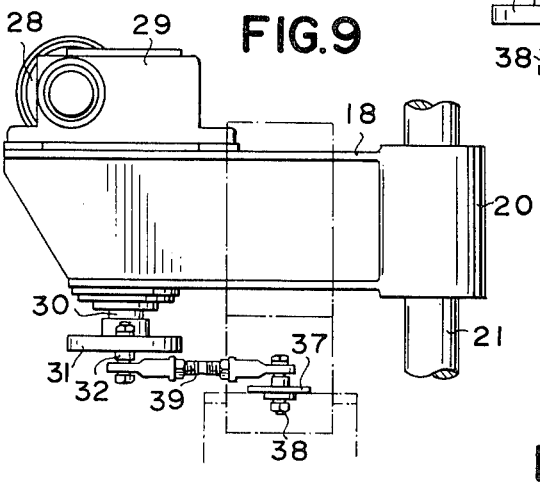
FIG. 9 is a side view of the same.
Figure 8:
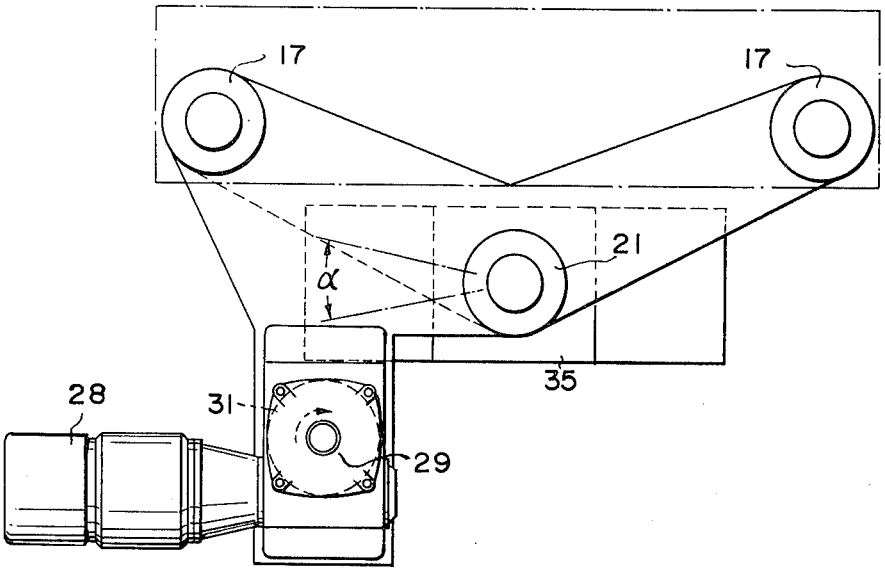
FIG. 8 is a plan view of the same.
Figure 10:
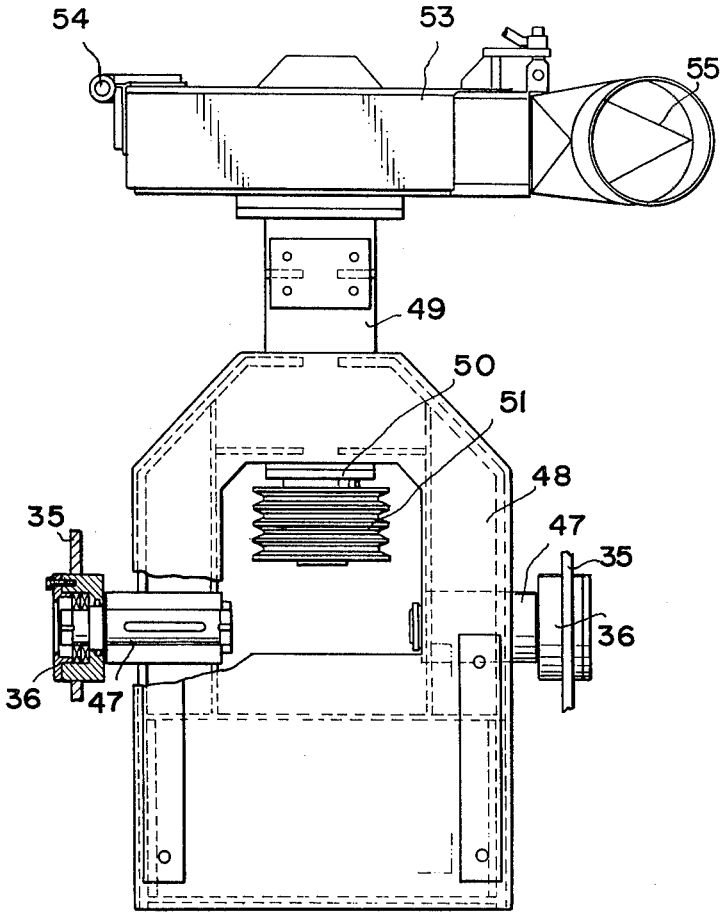
FIG. 10 is a partly broken-away enlarged-scale plan view of a grinding wheel swinging section.

As shown in FIGS. 5 and 10, a frame member 48, which is fixedly supported at its opposite sides by rotative shafts 47 journaled in the respective bearings 36 at the lower end of the fork-shaped pair frames 35, carries a bearing sleeve 49 secured to it and extending in the fore-and-aft direction. Rotatably received in the bearing sleeve 49 is a grinding wheel shaft 50, which carries a pulley 51 secured to its inner end and a replaceable grinding wheel 52 screwed to its outer end. The sleeve 49 is provided with a safety cover 53 hinged by hinge 54 to its outer end and capable of being opened and closed. The safety cover 53 is provided with a dust collection member 55. The pulley 51 is coupled via endless belts (not shown) to a pulley 57 of a grinding wheel drive motor 56 mounted in a lower portion of the transversal grinding unit 10 shown in FIG. 3.

The sleeve 49 is further provided on its upper portion near its front end with a bracket 58 secured to it by means of screws, and the rod 59 of the afore-mentioned air cylinder 43 is linked via a link 60 to the bracket 58.

Figure 1:
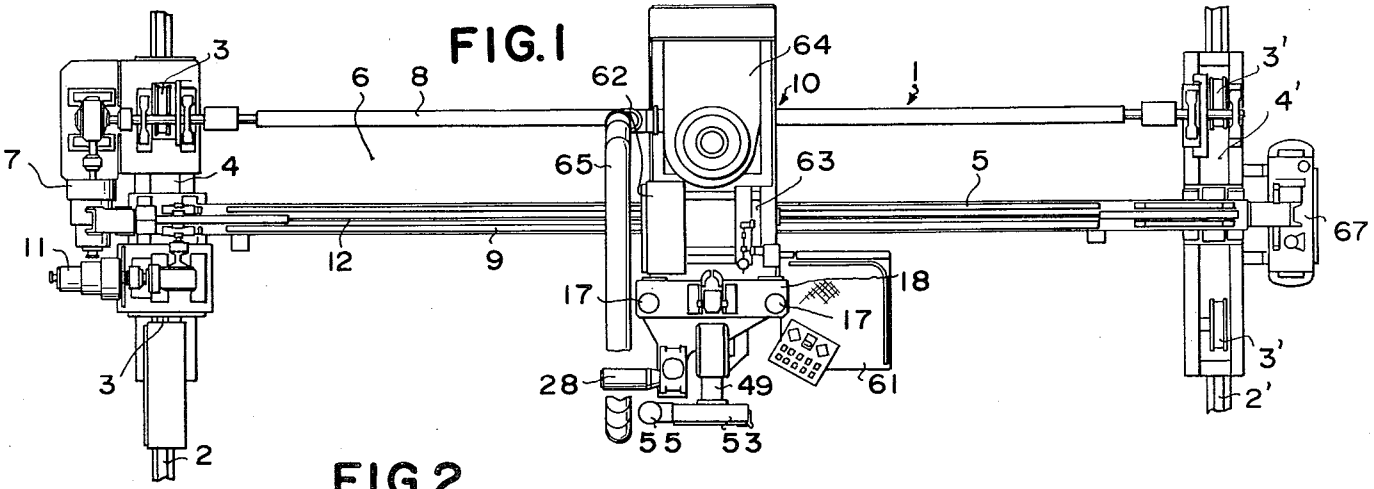
FIG. 1 is a plan view of a grinding machine embodying the invention.
Figure 2:
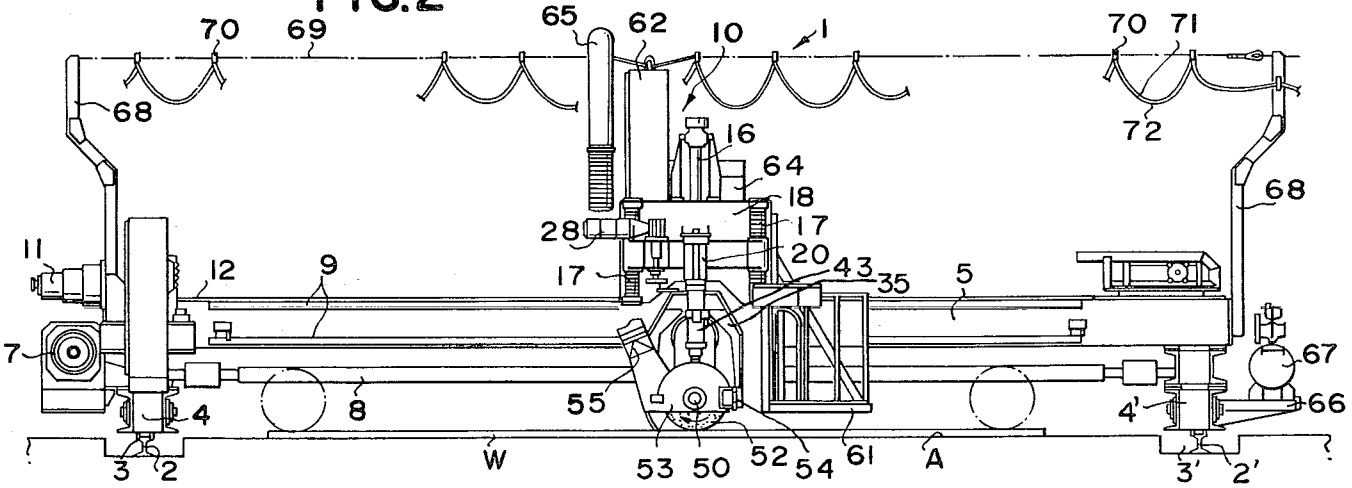
FIG. 2 is an elevational view of the same.

Referring back to FIGS. 1, 2 and 3, the transversal grinding unit 10 is further provided with an operator's seat 61, electric control unit 62, air control unit 63 and dust collector 64 having a bag filter. The afore-mentioned dust collection member is connected via flexible piping 65 to the dust collector 64. Further, an air compressor 67 is mounted on a base 66 secured to the wagon frame 4'. Electric wires and tubes are electrically and pneumatically arranged by cable group 72 and hose group 71 suspended by means of a number of rings 70 connected to wire 69, which is suspended between support pillars 68 extending upright on opposite sides of the wagon.

The operation will now be discussed with reference to the drawings. For the lower portion of the grinding wheel 52 to be substantially positioned directly above a local immperfection (not shown) on the workpiece W laid on the machine floor A, the operator on the operator's seat 61 moves the wagon by the wagon drive motor 7, and the transversal grinding unit is moved along the beam 5 by the transversal drive motor 11 in fast feeding (20 m/min). Then, the dust collector 64 and compressor 67 are started, and the grinding wheel 52 is run by the grinding wheel drive motor 56. Next, the grinding unit 10 is lowered by operating the power cylinder 16, and the horizontal drive is switched to the grinding feel (1 m/min). The oscillatory grinding is started by urging the grinding wheel in forced contact with the faulty surface and swinging the grinding wheel with respect to the approximate center of the faulty area while maintaining the preset grinding pressure. By operating the swing drive motor 28, the rotative disc is driven, and swinging of the fork-shaped pair frames 35 about the axis of the shaft member 21 over a given angle $\alpha$ is brought about by the adjustable connecting rod 39 of adjustable length connected for swinging between the bolt 32 extending from the rotative disc 28 and the bolt 38 extending from the tip of the support member 37 secured to the top of one of the fork-shaped pair frames 36. As a result, the frame member 48, shown in FIGS. 5 and 10, secured for vertical swinging to the shafts 47 facing end to end and rotatably supported at the lower end of the fork-shaped pair frames 35 is caused to swing in a horizontal plane by angle $\alpha$ with the grinding wheel shaft 50 accommodated in the sleeve 49. At the same time, the roller 46 rolling with a small clearance within the gap C between the cam members 25 and 26 disposed within the cam base 23 secured to the underside of the base member 22 secured to the top of the hollow cylindrical member 20 depending from the front side of the transversal beam 18, as shown in FIG. 5, is rotatably carried by the bolt 45 extending from the base member 44 at the top of the vertically pivotable L-shaped link 41 pivoted to the top of the support bracket 40 secured to the top of the fork-shaped pair frames 35, and therefore, with the swinging of the pair frames 35, the roller 46 is caused to reciprocate within the gap C between the cam members 25 and 26 with respect to the axis of the shaft member 21 in synchronization with the aforesaid swinging.

Meanwhile, the cam members 25 and 26 are shaped and disposed such that the radius of curvature of the intermediate line mid way between them is substantially equal to the radius of curvature of the swinging motion (200 m) at the center of the gap C while it is reduced to substantially one half the radius of curvature of swinging motion (100 m) near the ends of the gap. The cams are also set through fine adjustment by bolts 24 to make up for strain attributable to the skewness of the plane of swinging of the grinding wheel, whereby the L-shaped link 41 swings horizontally without being vertically turned due to the fact that the roller 46 is in the neighborhood of the gap C where the radius of curvature of the orbit of the roller motion is equal to that of the swinging of the pair frames 35. However, as the roller comes to the neighborhood of the ends of the gap C where the afore-mentioned radius of curvature is reduced to about one half, the upper end of the L-shaped link 41 is displaced in the direction of arrow P, causing the front end of the L-shaped link 41 to rise in the direction of arrow Q.

Since the front end of the L-shaped link 41 is coupled to the air cylinder 43 which controls the grinding pressure and is linked via the link 60 to the top of the bracket 58 secured to the front top of the sleeve 49 accommodating the grinding wheel shaft 50 as shown in FIG. 11, with the rising of the L-shaped link 41 the grinding wheel 50 is caused to turn upwardly with respect to the rotative shafts 47 of the frame 48. In this way, the grinding wheel 52 is upwardly pulled and smoothly separated from the surface of the workpiece W. Thus, no unevenness will be formed at the turning point of swinging of the gringing wheel.

While the period of the swinging motion is comparatively short, of the order of one reciprocation per second, the air cylinder 43 which is adjusted to control the grinding pressure to a preset pressure cannot follow rapid changes of pressure but can follow only gently changes. Thus, only changes of pressure due to large warp of the workpiece W or wear of the grinding wheel 52 will be followed to permit grinding with a constant grinding pressure.

When the grinding of one faulty area is completed, the grinding unit is raised by operating the power cylinder 16, and then it is moved to the next faulty area by switching the run and transversal drive to fast freed for the grinding of the new area in the same manner as described above.

With the construction according to the invention mentioned above local faulty surfaces of a thick plate having a broad area can be ground automatically without forming an uneven surface at points corresponding to the turning of the swinging grinding wheel. Also, grinding for the removal of faults and irregularities of the workpiece surface can be achieved readily and speedily with a predetermined grinding pressure by perfectly following large warp of the workpiece surface and wear of the grinding wheel to obtain a smooth finished surface. Further, it is possible to reduce the number of operators or personnel required for the grindings.

What is claimed is:

1. An apparatus for grinding surface portions of thick plates comprising parallel pair rails spaced a broad distance apart from each other, a gate-shaped wagon supported on and movable along said rails, and a transversal grinding unit supported on and movable along a transversal beam provided in said wagon, said grinding unit including a stationary frame, a transversal beam movably supported on said stationary frame, a hollow cylindrical member secured to a central front portion of said second-mentioned transversal beam, a shaft member rotatably received in said cylindrical member, fork-shaped pair frames fixed to and depending from the lower end of said shaft member, a vertically pivotable frame pivotably supported between the lower ends of said fork-shaped pair frames, a bearing sleeve secured to a front portion of said vertically pivotable frame, a grinder wheel shaft carrying a grinding wheel and rotatably received in said sleeve, means for swing said fork-shaped pair frames about an axis of said shaft member, cam means providing a gap, said cam means being mounted on the underside of a base member secured to the top of said cylindrical member receiving said shaft member, a roller capable of rolling along said gap in said cam means, said roller being rotatably supported on the top of a L-shaped vertically pivotable link pivoted to the top of said fork-shaped pair frames, the other end of said vertically pivotable link being linked via an air cylinder to a front upper portion of said sleeve.

2. An apparatus for grinding surface portions of thick plates according to claim 1, wherein the radius of curvature of the orbit of the motion of the center of said roller rolling within said gap of said cam means is substantially equal to the radius of curvature of the swinging motion of the grinding wheel at the center of the gap and is reduced toward the opposite ends of the gap, said roller being linked through said vertically pivotable L-shaped link and air cylinder to said grinding wheel shaft cylinder.

* * * * *